US009605214B1

(12) United States Patent
Weber

(10) Patent No.: US 9,605,214 B1
(45) Date of Patent: Mar. 28, 2017

(54) METHOD AND SYSTEM FOR EXTRACTING CATALYST FINES FROM SLURRY OIL CAT FINE BOTTOMS

(75) Inventor: Larry J. Weber, Houston, TX (US)

(73) Assignee: Cat' Fine Management Technologies, LLC, Liberty, TX (US)

( * ) Notice: Subject to any disclaimer, the term of this patent is extended or adjusted under 35 U.S.C. 154(b) by 200 days.

(21) Appl. No.: 13/352,328

(22) Filed: Jan. 17, 2012

Related U.S. Application Data

(60) Provisional application No. 61/461,163, filed on Jan. 14, 2012.

(51) Int. Cl.
*C10G 21/16* (2006.01)
*C10G 21/28* (2006.01)

(52) U.S. Cl.
CPC ..... *C10G 21/28* (2013.01); *C10G 21/16* (2013.01)

(58) Field of Classification Search
CPC ..... C10G 21/006; C10G 21/00; C10G 29/20; C10G 31/09; C10G 31/10; C10G 21/16; C10G 21/28; B01J 38/72
See application file for complete search history.

(56) References Cited

U.S. PATENT DOCUMENTS 2,790,753 A * 4/1957 Ackerman et al. ..... 208/96
2,879,224 A * 3/1959 Lawson ..... B01D 11/0223 208/100
4,094,770 A * 6/1978 Bose ..... B01D 21/00 208/251 R
4,206,001 A * 6/1980 Knowlton et al. ..... 134/12
4,264,428 A * 4/1981 Schoennagel et al. ..... 208/409
4,919,792 A * 4/1990 Huh ..... C10G 55/02 208/102
5,288,391 A * 2/1994 Biceroglu ..... B01D 17/047 208/13
5,518,621 A * 5/1996 Holcombe ..... B09C 1/02 210/634
2009/0120836 A1* 5/2009 Weber ..... 208/13
2009/0159505 A1* 6/2009 Da Costa et al. ..... 208/302

OTHER PUBLICATIONS

PALL Corporation, Fluid Catalytic Cracking Slurry Oil Clarification, 1999, p. 2.*
Clint Cooper, FCC Air/Steam Rings, Oct. 2011.*
Yanisko et al., Nitrogen: A Security Blanket for the Chemical Industry, CEP, Nov. 2011, pp. 50-56.*

* cited by examiner

*Primary Examiner* — Prem C Singh
*Assistant Examiner* — Brandi M Doyle
(74) *Attorney, Agent, or Firm* — Polster, Lieder, Woodruff & Lucchesi, LC

(57) ABSTRACT

A method for separating and isolating catalyst particles from the hydrocarbon component of a cat slurry oil of a fluid catalytic cracking unit (hereinafter SOCFBs) by mixing a low boiling point solvent with a quantity of SOCFBs in a digester, allowing catalyst fines to settle the bottom of a hydrocarbon layer (comprised of slurry oil, solvent and any diluent used to retrieve the SOCFBs) in the digester, decanting the hydrocarbon layer from the digester, and evaporating the low boiling point solvent from the settled catalyst fines.

16 Claims, 1 Drawing Sheet

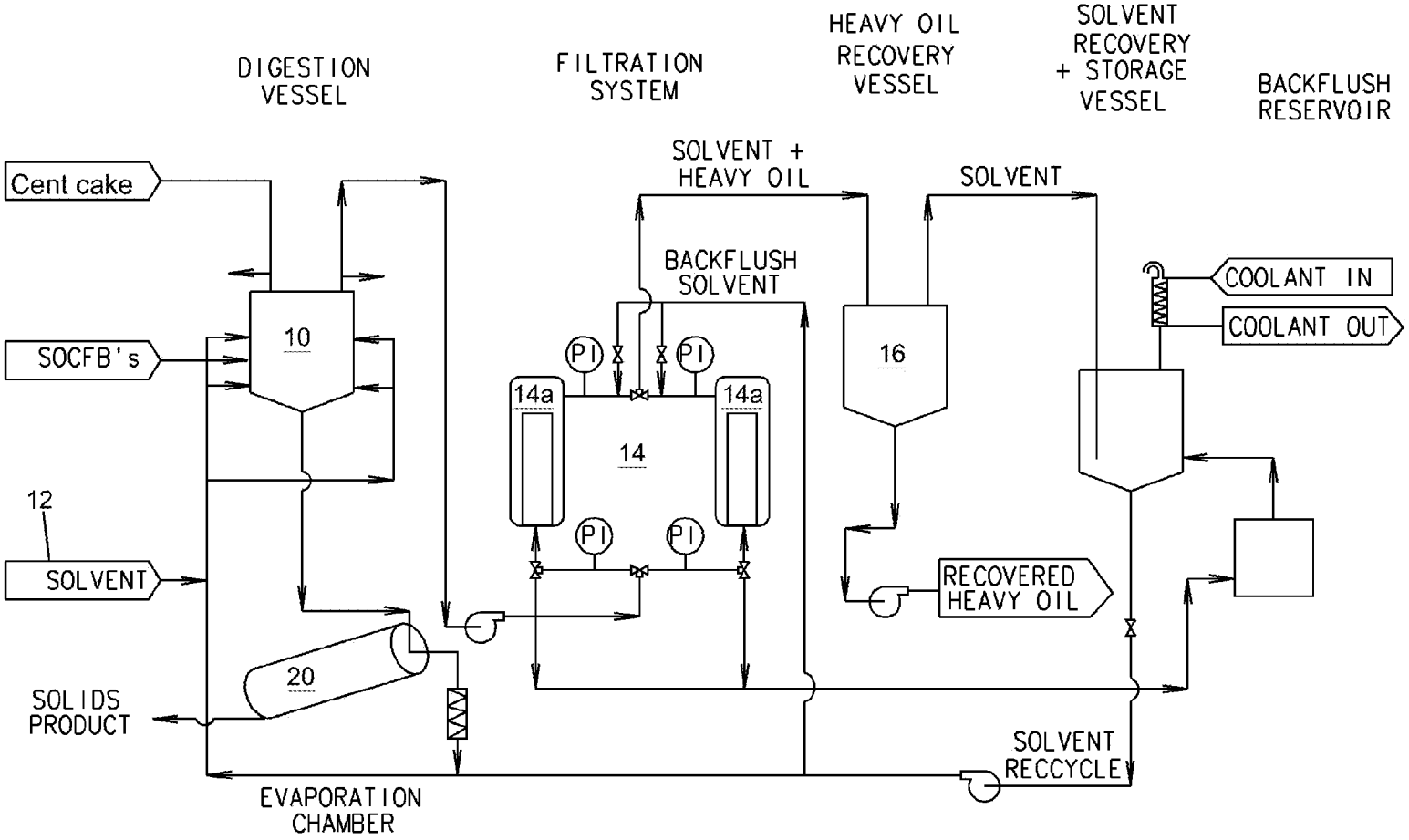
BACKFLUSH RESERVOIR
COOLANT IN
COOLANT OUT
SOLVENT RECOVERY + STORAGE VESSEL
SOLVENT
HEAVY OIL RECOVERY VESSEL
16
RECOVERED HEAVY OIL
SOLVENT RECYCLE
FILTRATION SYSTEM
SOLVENT + HEAVY OIL
BACKFLUSH SOLVENT
14a
14
PI
DIGESTION VESSEL
10
20
EVAPORATION CHAMBER
Cent cake
SOCFB's
12
SOLVENT
SOLIDS PRODUCT

METHOD AND SYSTEM FOR EXTRACTING CATALYST FINES FROM SLURRY OIL CAT FINE BOTTOMS

The present application claims priority to U.S. Provisional Patent Application No. 61/461,163 entitled "FCC-LBPSE METHOD AND SYSTEM FOR EXTRACTING CATALYST FINES FROM SLURRY OIL CAT' FINE BOTTOMS (SOCFB's) INTO A LOW BOILING POINT SOLVENT" filed Jan. 14, 2011, the contents of which are incorporated herein by reference.

FIELD OF THE INVENTION

The present invention relates to a system and method for the separation of Slurry Oil Cat' Fine Bottoms (SOCFBs) generated by a fluid catalytic cracking unit, and which has been termed K-170 by the US EPA into its organic and inorganic components by the separation of the FCC slurry oil component of the SOCFBs/K-170 and any diluent used to mobilize the SOCFBs/K-170 for removal from FCC a slurry oil storage tank from the catalyst fines component of the SOCFBs/K-170, centrifuge-processed cat fine cake, or SOCFBs/K-170 directly retrieved without diluent into a non-aromatic low boiling point solvent (LBPS). The low boiling point solvent is preferably a ketone, and more preferably dimethyl formaldehyde (DMF). The nature of the solvent enhances and enables economical recycle of the solvent and processing efficiency heretofore unachieved.

BACKGROUND OF THE INVENTION

Slurry Oil/Catalyst Fines Tank Bottoms Recovery & Processing

The problems presented by catalyst attrition from fluid catalytic cracking units (FCCU) have plagued the refining industry since the advent of fluid catalytic cracking in the first half of the 20th century. Over time, FCCU catalyst deteriorates in size. The size-deteriorated catalyst is commonly referred to as "cat' fines".

In the FCCU process, cracked product stream vapor and some catalyst leave the reactor and enter the main fractionator near its base. On most fluid catalytic cracking units the bottom stream from the fractionator is called heavy cycle oil (HCO) or FCC slurry oil. This FCC slurry oil comprises catalyst fines in a hydrocarbon component, with the hydrocarbon component being comprised of hydrocarbons having aromatics, doubly bonded carbons, carbon-sulfur bonds and carbon-nitrogen bonds. The term slurry oil has arisen as a result of the presence of catalyst particles in the FCC fractionation tower's "bottom product", i.e. FCC slurry oil. For purposes of the present invention, it is sufficient to know that catalyst particles make their way to the slurry oil product storage tank. Slurry oil is a saleable product of fluid catalytic cracking processing. Once in the storage tank, the catalyst fines settle to the bottom, albeit very slowly. The layering of accumulated FCC catalyst fines that settle to the bottom of the slurry oil storage tank was labeled as a hazardous waste and termed as K-170 in the United States Resource Conservation and Recovery Act (RCRA). The K-170 is also referred to herein as slurry oil cat' fine bottoms or SOCFBs, as noted above. Hence, herein, SOCFBs and K-170 are synonymous.

The existence of catalyst fines in the slurry tank presents a variety of problems to the refiner. The immediate and obvious problem has to do with product contamination. Slurry oil has proven to be an ideal feedstock for carbon black manufacture. Utilization as carbon black feedstock maximizes the value of slurry oil product. However, the presence of catalyst fines above a specified percentage in the slurry oil product results in an "ash content" (i.e., catalyst fines content) in excess of that specification which is acceptable for use of the slurry oil as a carbon black feedstock. Even when the slurry oil product is utilized as a fuel source, a "price penalty" is effectively born as ash content, in the form of the inorganic catalyst fines, increases.

Firms within the specialty chemical industry which service the petroleum refining industry have built proprietary product lines that serve to enhance settling of the catalyst fines in the slurry oil storage tank. In recently or relatively recently cleaned storage tanks this procedure is typically successful in enabling the stored FCC slurry oil product to meet even the rigorous specifications of carbon black manufacturers. As the accumulation of catalyst fines from FCCUs continues in the storage tank, a time comes when no amount of settling enhancement will permit the stored product to "meet specification" of carbon black manufacturers or even fuel products. A second dictate that compels the control of SOCFB accumulation has to do with storage tank inspection criteria. Regulatory authorities require storage tank inspection at specified intervals. The presence of SOCFB's/K-170 interferes with that exercise.

When accumulation of catalyst fines in the FCC slurry oil storage tank becomes intolerable, in terms of meeting product specification or inspection criteria, refinery management schedules a clean-out. The clean-out is typically conducted under one of two typical scenarios. One type of clean-out, referred to as a "partial clean-out" calls for the removal of the catalyst fines without human entry. In this instance, enough of the catalyst fine sediment is removed to make the bottoms manageable once again. Another type of clean-out entails a complete removal of all catalyst fine sediment, subsequent human entry for rigorous clean up and a so-called mop-up, all followed by inspection, repairs and return-to-service.

The low API gravity/high density of the FCC slurry oil, coupled with the entrained catalyst fines, contributes to recovery and handling problems that are reputed to be some of the toughest in the tank cleaning industry. The tank cleaning industry has devised a number of procedures for catalyst fine removal from FCC slurry oil storage tanks. These include the injection of diluent at high pressure either via side ports or from the roof, the cutting of "door sheets" using a water torch and various probe insertion devices. One such insertion device was co-invented by the present inventor and is called the SWEEPBER. It is the subject of U.S. Pat. No. 6,142,160, which serves the purpose of recovering catalyst fines from the bottom of slurry oil storage vessels. A diluent is required to enable ease of handling of the catalyst fine bottoms in all instances known to this inventor. The observed and preferred diluent of choice is Light Cycle Oil or LCO, a side-cut of the FCCU fractionation tower.

The preponderance of catalyst fine projects, observed by the present inventor, are then conducted in a manner described as follows: As removal from the tank is carried out the typical procedure calls for transfer of the slurry oil/catalyst fines/diluent mixture (hereinafter SCDM) to a mobile mix tank, such as that supplied by Baker Tanks Inc., of approximately 22,000 gallons (approximately 500 barrels) capacity. The mix tank has the capability of heating the contents. A heated catalyst fine suspension of pre-specified temperature and concentration is then prepared in the mix tank as feed for centrifuge processing. The desired concentration of cat fines in the SCDM feed to the centrifuge, as relayed by numerous industry professionals, is 15% to 20%.

The heated feed is charged to the centrifuge and processed at a typical rate of 35 gal/min to 42 gal/min. Two streams result from the centrifuge process. One stream is referred to as recovered oil and the second stream is referred to as "filter cake" or "cat fine cake". The recovered oil, typically having a basic sediment and water (BS&W) content of about 0.5% to 10% (28.5% solids by BS&W has been observed by this inventor), is utilized per refinery management discretion. Typical options include blending the recovered oil into heavy fuel oil products or, depending on BS &W, transfer to slop oil storage inventory for re-processing with the crude oil charge to the refinery crude unit via the desalter.

Pursuant to current U.S. Resource Conservation and Recovery Act guidelines, the filter cake, like the SOCFBs/K-170 itself, is considered a hazardous waste, as noted above. The cost of disposal of this cat fine cake has risen by ten-fold since the mid-1990's and is expected to continue rising. The principal specification that governs the acceptability of filter cake pricing and disposal to a hazardous waste landfill is the "paint filter test". This test requires the absence of free flowing oil through a standard filter. However, despite the absence of free-flowing oil within the filter cake, a substantial amount of hydrocarbon content remains within the filter cake and, thus, goes unutilized while it remains to impact the environment.

It is not unusual to find that the true hydrocarbon content of post-centrifuged filter cake is greater than 50%. It has been observed that filter cake of high melting point hydrocarbons, such as slurry oil, may contain as much as 83% hydrocarbon. The determination of true hydrocarbon content may be found by conducting a standard ASTM procedure for oil and grease or a true distillation.

There is a currently-used, second method of disposal for filter cake that renders the cake non-hazardous under EPA guidelines. The method is described in U.S. Pat. No. 5,443,717 issued to Robert M. Scalliet; et al. entitled "Recycle of Waste Streams".

A method for recovering the hydrocarbon component of SOCFB's has been invented by the present inventor and allowed as U.S. Pat. No. 7,244,364 and entitled FCC-CFD Cat' Fine Desalting: A Method And System For Separating Hydrocarbons And Extracting Catalyst Fines From A Slurry Oil/Catalyst Fines/Diluent Mixture. This FCC-CFD method serves the purpose of recovering the hydrocarbon component of SOCFB's at a recovery rate of 99%+. However, "CFD" does not address the recovery and economic disposition of the catalyst component of SOCFB's. In the instance of the FCC-CFD method, the catalyst component is extracted from the Slurry Oil Cat' Fines Diluent Mixture (SCDM) into the water layer during the continuous refinery desalting process. The solids contained in the desalter effluent water are classified as a hazardous waste by the US EPA. Alternatively, the present invention serves to both recover the hydrocarbon component of the SCDM with hydrocracker feedstock quality, in terms of low ash content, while "hydrocarbon scrubbing" the catalyst, and rendering the catalyst component as an easily managed dry powder capable of handling by pneumatic systems found in the FCCU make-up catalyst system or in the cement manufacturing industry.

Disposition of Recovered Catalyst

There are two preferred disposition options available as a "closing of the loop" of the catalyst component of SOCFB's. The ideal option is to recharge catalyst, recovered by the LBPSE method, into the FCCU via the make-up catalyst route or slipstreamed into the make-up catalyst system via a proprietary catalyst additive system. Upon recharging of the cat' fines, a preponderance of the recharged, reclaimed catalyst will attrite via the FCC regenerator scrubber system and thereby be rendered non-hazardous while off-setting makeup catalyst requirements. There is the further benefit of a "metals flush" of mobile vanadium compounds that occurs as vanadium compounds are deposited on the cat' fines and flushed into the scrubber system.

An ideal situation occurs when an opportunity to cascade this catalyst to an alternate FCCU where there is significant differential, in terms of lesser activity requirement, presents itself.

The second option for the catalyst is as a cement kiln feedstock. The primary chemical constituents of FCC catalyst are the oxides of silica and aluminum; the very same primary components of typical cement kiln feed. Catalyst reclaimed by the LBPSE Method eminently qualifies for this option because of the form in which it is reclaimed, i.e. as a free-flowing powdered material capable of being handled by standard cement kiln pneumatic systems. Catalyst reclaimed by the LBPSE Method contains 2% to as much as 12% hydrocarbon which serves to subsidize the BTU requirements of the cement kiln. The LBPSE method provides that the percentage of hydrocarbon residual remaining in and on the catalyst can be varied to predetermined specification by the number and proportion of extractions.

SUMMARY OF THE INVENTION

The present invention comprises a method for separating and isolating catalyst particles from the hydrocarbon component of SOCFB's in a form amenable to handling by pneumatic systems. A low boiling point solvent (LBPS), found to be especially suitable for extracting FCC slurry oil and typical FCC slurry oil diluents at nominal temperatures, is added and mixed with the SOCFB s at ambient temperature. The preferred solvent is dimethyl formaldehyde (DMF), a ketone. An organic mixture comprised of the solvent, the slurry oil/HCO, and any mobilization diluent is then decanted and/or filtered from the inorganic component. A second or third extraction may be performed. It is found that a point of diminishing returns, in terms of the quantity of heavy cycle oil extracted from the SOCFBs, is rapidly reached. It has been found that two extractions with a 2:1, LBPS to SOCFB, ratio will typically achieve an extraction of 95% of the heavy cycle oil from the SOCFBs. Thereafter, only minimal gains of heavy cycle oil retrieval can be achieved. After the solvent/heavy cycle oil mixture is separated from the catalyst fines and further filtered; the LBPS may then be readily distilled from the HCO/LCO/LBPS mixture with minimal thermal requirement. The solvent is then recovered and recycled into the LBPSE Process.

DESCRIPTION OF THE DRAWINGS

FIG. 1 is a schematic of the preferred embodiment of the present invention.

DESCRIPTION OF THE PREFERRED EMBODIMENT

While the invention is susceptible of embodiment in many different forms, there is described in detail preferred embodiments of the invention. It is to be understood that the present disclosure is to be considered only as an example of the principles of the invention. This disclosure is not intended to limit the broad aspect of the invention to the illustrated embodiments. The scope of protection should only be limited by the claims.

Referring to the Figure, an exemplary exercise of the present invention occurs in four stages. These are the A. the Digestion, decant & catalyst off-loading stage, B. the Filtration stage, C. the Distillation & Solvent Recovery stage, and D. the Recycle stage. In a broad overview of the present invention, the resolution of the components of Slurry Oil Cat' Fine Bottoms (SOCFBs) generated by an FCCU (i.e., K-170), being the recovery of the heavy cycle oil component of the FCCU SOCFBs and the separation of the inorganic catalyst components of the FCCU SOCFBs into a free-flowing powder form, is accomplished by mixing the FCCU SOCFB's with a predetermined amount of low boiling point solvent (LBPS). The preferred solvent is dimethyl formaldehyde (DMF), a ketone. An organic mixture comprising the solvent, the heavy cycle oil, and any diluent is then decanted to separate the catalyst fines (the solid component) from the organic mixture, and the organic mixture is filtered. The solvent is then distilled from the heavy cycle oil and any diluent with minimal thermal requirements and finally the solvent is recycled back into the LBPSE Process. The "solvent/HCO-wet" catalyst (i.e., the solid component) is prepared to a "dry" powdered form by vaporization of any remaining solvent. This is performed by a combination of mixing/fluffing in order to expose catalyst surface area to the nitrogen atmosphere and enable vaporization of the solvent, while still in the Digester. The slow-moving, positive-pressure nitrogen "blanket" serves to enhance vaporization and mobilization of the LBPS. Subsequently the catalyst is transferred to an Evaporation Chamber which removes residual solvent with a combination of agitation and mild heat.

The present invention comprises a method for separating FCC catalyst particles from FCCU Slurry Oil Cat' Fine Bottoms (K-170) and decontaminating the heavy cycle oils, slurry oil (HCO), and Light Cycle Oil (LCO) contained in the SOCFBs/K-170 of catalyst comprising the steps of:

(1) Preparing a mixture of Slurry Oil Cat Fine Bottoms, previously extracted with Light Cycle Oil (LCO) by an assortment of means subsequently described immediately below in this section, with a Low Boiling Point Solvent (LBPS), typically having a boiling point of less than 200° F., in a Digester. Low Boiling Point Solvents that have been shown to work in the context of this invention include, petroleum ether, methylene chloride and dimethyl formaldehyde also known as propan-2-one, none of which are aromatics. The preferred solvent is dimethyl formaldehyde, a ketone. The typical extraction ratio of LBPS to LCO-extracted SOCFBs ranges from 0.5 to 1 to 2 to 1.

It has been found that the extraction with a LBPS works most economically if the FCCU SOCFB's have been previously extracted with Light Cycle Oil (commonly referred to as LCO). The FCCU SOCFB's being mixed and extracted in the Digester by the LBPS will commonly take the form of either "virgin" SOCFBs that have been previously diluted and/or extracted with LCO or, more typically, "virgin" SOCFBs that have been previously diluted and/or extracted with LCO and subsequently processed through a centrifuge thereby yielding a so-called Cat Fine Cake. If the "virgin" SOCFBs have not been extracted with LCO, it is found that higher rates of LBPS dilution are required.

The dilution of "virgin" FCCU SOCFBs with the objective of mobilizing the SOCFBs to a liquid state is a common practice that has been developed over decades by firms and craftsmen that specialize in the art of cleaning slurry oil storage tanks. The common method of mobilizing the all-but-solid SOCFB's (at ambient temperatures) is by the addition of LCO. The dilution ratio of LCO to FCCU SOCFBs is at a typical range of 2 to 1 to as much as 5 to 1. Mobilization of the FCCU SOCFBs is highly temperature dependant. The LCO is typically produced in the same Fluid Catalytic Cracking Unit from whence the SOCFBs were created making it readily available for the recovery exercise.

In that regard, an exemplary method of preparing the mixture of LCO-extracted SOCFB's and LBPS (with reference to the Figure) is as follows:

A. The FCCU generated SOCFBs that have been extracted from a storage tank using LCO are charged to a Digester 10 as a mobile liquid or cat fine cake.

B. The Digester is hermetically sealed in preparation for addition of the Low Boiling Point, i.e. volatile, Solvent.

C. A "nitrogen blanket" is then introduced into the Digester.

D. The LBPS 12 is then charged to the Digester 10 at a pre-determined volume ratio.

E. The mixture (i.e., the SOCFBs, LCO, and solvent) is then agitated using mixing propellers at ambient temperature of from about 40° F. to about 100° F. (about 4° C. to about 37° C.) in order to extract the LCO and Slurry Oil in the solvent.

F. Once mixing has taken place such that extraction of the hydrocarbon component (i.e., HCO) of the SOCFBs into the LBPS has occurred, mixing is terminated and the mixture is allowed to settle, thus forming a lower Cat' Fines solid layer and an upper organic layer in the digester. Settling of the Cat' Fines from the upper, liquid layer of the Digestion Mixture occurs rapidly, according to Stoke's Law, due to the decreased viscosity of the HCO/LCO/LBPS Mixture resulting from the LBPS dilution.

G. Once the Cat' Fines solid component of the Digestion Mixture has settled, the upper liquid (i.e., the organic component) is decanted from the digester, filtered in a filtration system 14, and sent to the Heavy Cycle Oil Recovery Vessel 16 which has heating capabilities.

H. The settled cat fines may then be processed with a second or even third extraction and decantation by the introduction of additional LBPS without unsealing the Digester Vessel. The extraction technique may be used to vary the concentration of residual hydrocarbon in and on the catalyst fines. Minimal levels of hydrocarbon residual, on and in the cat' fines, are desirable for purposes of maintaining air quality (minimization of dust) during subsequent handling and transport I. Upon determination that the extraction exercise is complete, the "HCO/LCO/LBPS-moist" cat fines are then mixed further in the digester 10 in an exercise referred to in this invention as "fluffing". The same mixing paddles used for digestion are used for "fluffing". The object of the "fluffing" exercise is to expose the LBPS to the nitrogen atmosphere thereby enhancing evaporation.

J. A resulting effect of "fluffing" is that, as the LBPS is evaporated, the cat' fines return to a dry, solid, but fluid, state just as they were originally manufactured to behave.

K. LBPS evaporation is enhanced by the slow movement of nitrogen through the LBPSE Processing System, brought on by a slight positive pressure characteristic of a nitrogen blanket, as fluffing occurs. This has the advantage of decreasing thermal energy requirements for both the drying of the Cat' Fines and in the recovery of the solvent.

(2) Mixing the Prepared Mixture of SOCFB's, LCO and LBPS in the Digester Vessel while still under a nitrogen blanket in order to dissolve the heavy cycle oil component of SOCFBs into the LBPS.

(3) Allowing the solid Cat' Fine component of the SOCFBs/LCO/LBPSE Mixture to settle after mixing to form the catalyst layer and hydrocarbon layer in the digester.

(4) Decanting the upper liquid organic layer comprised of HCO, LCO and LBPS and sending the decanted organic mixture though a filtration system.

(5) Optionally repeating the extraction by the subsequent addition of LBPS, settling, decantation and filtration.

(6) "Fluffing" the settled cat fines by agitation, in the digester, in order to enhance further evaporation of the LBPS.

(7) Processing of the decanted HCO/LCO/LBPS mixture through a filtration system, for decontamination of entrained catalyst fines, and into the Heavy Cycle Oil Recovery Vessel. The filtration method of choice is with the use of porous metal filters 14*a* as supplied by Mott Corporation of Farmington, Conn.

(8) Heating, Distillation and recovery of LBPS from the HCO/LCO/LBPS Mixture.

(9) Transfer of the Cat Fines from the Digester to an Evaporation Chamber. Once the cat' fines remaining in the Digester 10 have been processed to a state such that they behave, once again, as a "fluid" catalyst and amenable to handling and transport by conventional pneumatic systems, the cat fines are removed from the digester 10 via a hermetically sealed transfer line and deposited in a hermetically sealed Evaporation Chamber 20 designed to remove and recover any remaining LBPS. The Evaporation Chamber 20 is equipped with heating capability to 10 degrees above the boiling point of any LBPS anticipated for use in the LBPSE Process. The Evaporation Chamber is equipped with means of agitation such as a rolling drum or internal mixers. In that the LBPSE Method is a batch process, transfer to the Evaporation Vessel provides for maximum utilization of the Digester Vessel.

While the specific embodiments have been described, numerous modifications come to mind without significantly departing from the spirit of the invention and the scope of protection should only be limited by the scope of the claims yet to be stated.

I claim:

1. A method for treating and processing slurry oil cat fine bottoms (hereinafter SOCFBs) generated by a fluid catalytic cracking unit, the SOCFBs comprising FCC catalyst particles and a heavy cycle oil (HCO) hydrocarbon component, the HCO comprising hydrocarbons containing aromatics, doubly bonded carbons, carbon-sulfur bonds, and/or carbon-nitrogen bonds, to separate and isolate the catalyst particles of the SOCFBs from a HCO component of the SOCFBs and to extract from the catalyst particles the HCO which infiltrated the catalyst particles, the method comprising:

mixing a non-aromatic solvent having a boiling point of below 200° F. with a quantity of SOCFBs in a digester at ambient temperature to extract infiltrated HCO from the catalyst particles and to separate the catalyst particles from the HCO, said solvent being propan-2-one (also known as dimethyl formaldehyde, hereinafter "DMF");

allowing the catalyst particles to settle in the digester to thereby form an upper layer of an organic mixture comprised of dissolved HCO and the solvent, and a substantially hydrocarbon-free lower layer comprised of solvent/HCO-moist catalyst particles;

decanting the organic mixture from the digester leaving the lower layer of solvent/HCO-moist catalyst;

transferring the solvent/HCO-moist catalyst particles to an evaporation chamber; and evaporating the solvent from the solvent/HCO-moist catalyst to form a dried substantially solvent-free catalyst product capable of being handled by pneumatic systems.

2. The method of claim 1 wherein the steps of mixing and decanting are performed a plurality of times before the step of evaporating.

3. The method of claim 1 comprising a step of separating the decanted organic mixture into a solvent component and an oil component.

4. The method of claim 3 further comprising a step of filtering the decanted organic layer before the step of separating the solvent from the oil to remove catalyst that may be in the organic component.

5. The method of claim 4 wherein subsequent to said filtering step and before the evaporating step at least a portion of a retentate of the filtering step is returned to said digester to again be mixed with solvent to be processed in the digester.

6. The method of claim 3 wherein the solvent component is separated from the oil component of the organic mixture via distillation.

7. The method of claim 1 wherein the catalyst product is 2% to 12% HCO.

8. The method of claim 1 wherein the solvent to SOCFBs ratio is 2:1.

9. The method of claim 1 wherein the step of mixing the solvent and SOCFBs is carried out at a temperature of about 40° F. to about 100° F.

10. The method of claim 1 wherein the SOCFBs are diluted with a light cycle oil prior to mixing with the solvent in order to mobilize the SOCFBs, and wherein the diluted SOCFBs are centrifuged, such that the SOCFBs are concentrated to a cat fine cake, and wherein the cat fine cake is the feed for the method.

11. The method of claim 10 wherein the ratio of light cycle oil used for dilution and/or mobilization of the SOCFBs is 2:1 to 5:1.

12. The method of claim 1 wherein the mixing step occurs under a nitrogen atmosphere.

13. The method of claim 1 including a step of evaporating a portion of the solvent remaining with the solvent-moist catalyst particles after the organic layer has been decanted to partially dry the catalyst particles.

14. The method of claim 13 wherein the step of evaporating a portion of the solvent remaining with the solvent-moist catalyst particles in the digester comprises mechanically fluffing the catalyst separated from the SOCFBs after the step of decanting to expose any solvent remaining with the catalyst to the atmosphere in the digester to thereby enhance evaporation of the solvent from the catalyst in the digester.

15. The method of claim 14, wherein said digester contains mixing paddles, wherein said mixing paddles are used both for said mixing step and said fluffing step.

16. A method for treating and processing slurry oil cat fine bottoms (hereinafter SOCFBs) generated by a fluid catalytic cracking unit, the SOCFBs comprising FCC catalyst particles and a heavy cycle oil (HCO) hydrocarbon component, the HCO comprising hydrocarbons containing aromatics, doubly bonded carbons, carbon-sulfur bonds, and/or carbon-nitrogen bonds, to separate and isolate the catalyst particles of the SOCFBs from a HCO component of the SOCFBs and to extract from the catalyst particles the HCO which infiltrated the catalyst particles, the method comprising:

mixing a non-aromatic solvent having a boiling point of below 200° F. with a quantity of SOCFBs in a digester at ambient temperature to extract infiltrated HCO from the catalyst particles and to separate the catalyst particles from the HCO, said solvent consisting of propan-2-one (also known as dimethyl formaldehyde, hereinafter "DMF");

allowing the catalyst particles to settle in the digester to thereby form an upper layer of an organic mixture comprised of dissolved HCO and the solvent, and a substantially hydrocarbon-free lower layer comprised of solvent/HCO-moist catalyst particles;

decanting the upper layer of organic mixture from the digester leaving the lower layer of solvent/HCO-moist catalyst; and evaporating the solvent from the solvent/HCO-moist catalyst to form a dried substantially solvent-free catalyst product capable of being handled by pneumatic systems.

* * * * *